United States Patent [19]

Hudson et al.

[11] Patent Number: 4,458,976

[45] Date of Patent: Jul. 10, 1984

[54] TERMINAL AND CONNECTOR ASSEMBLY FOR ELECTRICAL CABLES

[75] Inventors: John A. Hudson; Warren H. Biegler, both of Panama City, Fla.

[73] Assignee: The United States of America as represented by the Secretary of the Navy, Washington, D.C.

[21] Appl. No.: 434,214

[22] Filed: Oct. 14, 1982

[51] Int. Cl.[3] ..... H01R 4/46

[52] U.S. Cl. ..... 339/248 R; 339/265 R

[58] Field of Search ..... 339/272, 265 R, 265 F, 339/244 VC, 249 R, 249 A, 249 S, 205, 248

[56] References Cited

U.S. PATENT DOCUMENTS

| | | | |
|---|---|---|---|
| 1,646,255 | 10/1927 | Muehleman . | |
| 1,940,704 | 12/1933 | Sumpter et al. | 173/263 |
| 2,425,764 | 8/1947 | Tenney | 173/259 |
| 2,937,226 | 5/1960 | Kaminski, Jr. et al. | 174/40 |
| 2,946,108 | 7/1960 | Bethea | 24/135 |
| 2,999,223 | 9/1961 | Peter | 339/205 |
| 3,023,391 | 2/1962 | Pahl | 339/31 |
| 3,100,672 | 8/1963 | Myers | 339/265 |
| 3,393,393 | 7/1968 | Hart | 339/265 F |
| 3,940,732 | 2/1976 | Hudson | 340/4 E |
| 4,117,447 | 9/1978 | Gould et al. | 340/4 E |

FOREIGN PATENT DOCUMENTS

| | | | |
|---|---|---|---|
| 634989 | 1/1964 | France | 339/205 |

*Primary Examiner*—John McQuade
*Assistant Examiner*—David L. Pirlot
*Attorney, Agent, or Firm*—Robert F. Beers; Harvey A. David

[57] ABSTRACT

A terminal and connector assembly for effecting end-to-end electrical and mechanical coupling of the ends of large diameter cables without need of rotative alignment. End terminals fixed to the cables have axially projecting stems with knobs at the ends that are received in a complementary recess in a connector body and clamped by a keeper that fills the recess and is secured by U-bolts that are also recessed.

4 Claims, 2 Drawing Figures

TERMINAL AND CONNECTOR ASSEMBLY FOR ELECTRICAL CABLES

BACKGROUND OF THE INVENTION

This invention relates to connectors for cables, for example of the type that are used in sweeping of magnetic influence marine mines, and more particularly to improvements in the end terminals and connectors for end-to-end connection thereof to one another and to electrical supply cables.

Cables of the type concerned are disclosed in U.S. Pat. Nos. 3,940,732 and 4,117,447. They generally comprise a central strength member surrounded by a cylindrical buoyant sleeve of a closed cell plastic foam material, and a conductive layer formed of helically wound strands of aluminum wire. At least one end and at times both ends of the electrode cables and the associated supply cables are provided with a connector terminal having an offset, apertured spade lug that can be bolted to the offset lug of a mating connector terminal. In making such a connection, it has been necessary that the lugs of the terminals being connected are properly rotatively oriented relative to one another so that the offsets are complementary, and the bolt holes are aligned. Because the electrodes and supply cables are on the order of five or more inches in diameter, are stiff and resistant to axial twist, great difficulty has at times been experienced in effecting a connection. Since the connections are often required to be made under adverse, at sea conditions, there exists a need for an electrode or cable terminal and connector that can be utilized for coupling and uncoupling such cables or electrodes without requiring any rotative alignment in the process.

SUMMARY OF THE INVENTION

With the foregoing in mind, it is a principal object of the invention to provide an improved terminal and connector assembly for use in combination with heavy cables for effecting end-to-end coupling thereof without requiring rotative alignment, and which is simple and easy to use under adverse conditions.

Another object of the invention is to provide an end-to-end terminal and connector assembly for electrodes or cables that presents a relatively smooth exterior and is of substantially the same diameter as the cables being connected, so as to pass readily through chocks or other handling equipment without interference.

Yet another object is to provide a terminal and connector assembly of the foregoing character that provides an adequate current carrying path between the cables or electrodes connected.

Other objects and many of the attendant advantages will be readily appreciated as the subject invention becomes better understood by reference to the following detailed description, when considered in conjunction with the accompanying drawings.

DESCRIPTION OF THE PREFERRED EMBODIMENT

Figure 1:
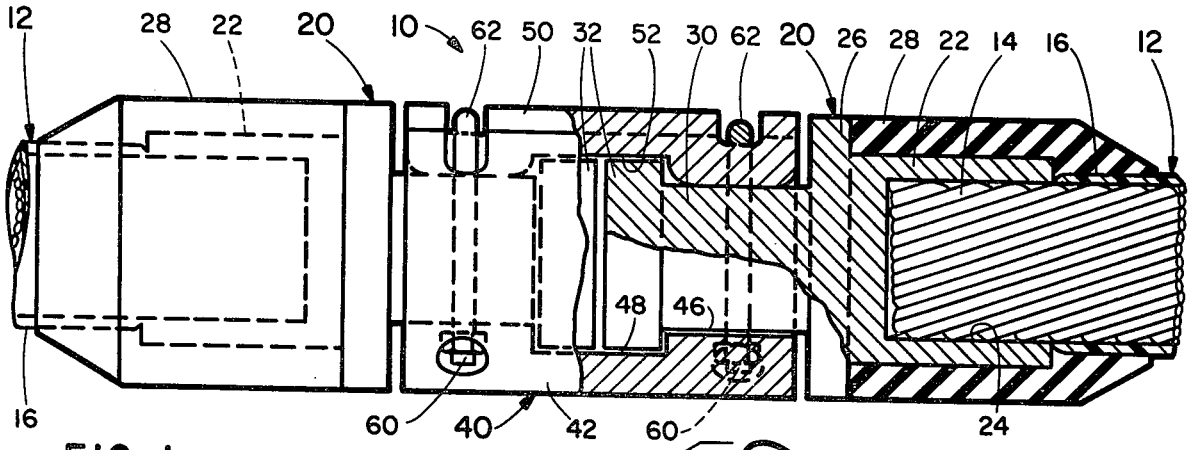
FIG. 1 is a side view of a cable terminal and connector assembly embodying the invention, shown partly in elevation and partly in section.
Figure 2:
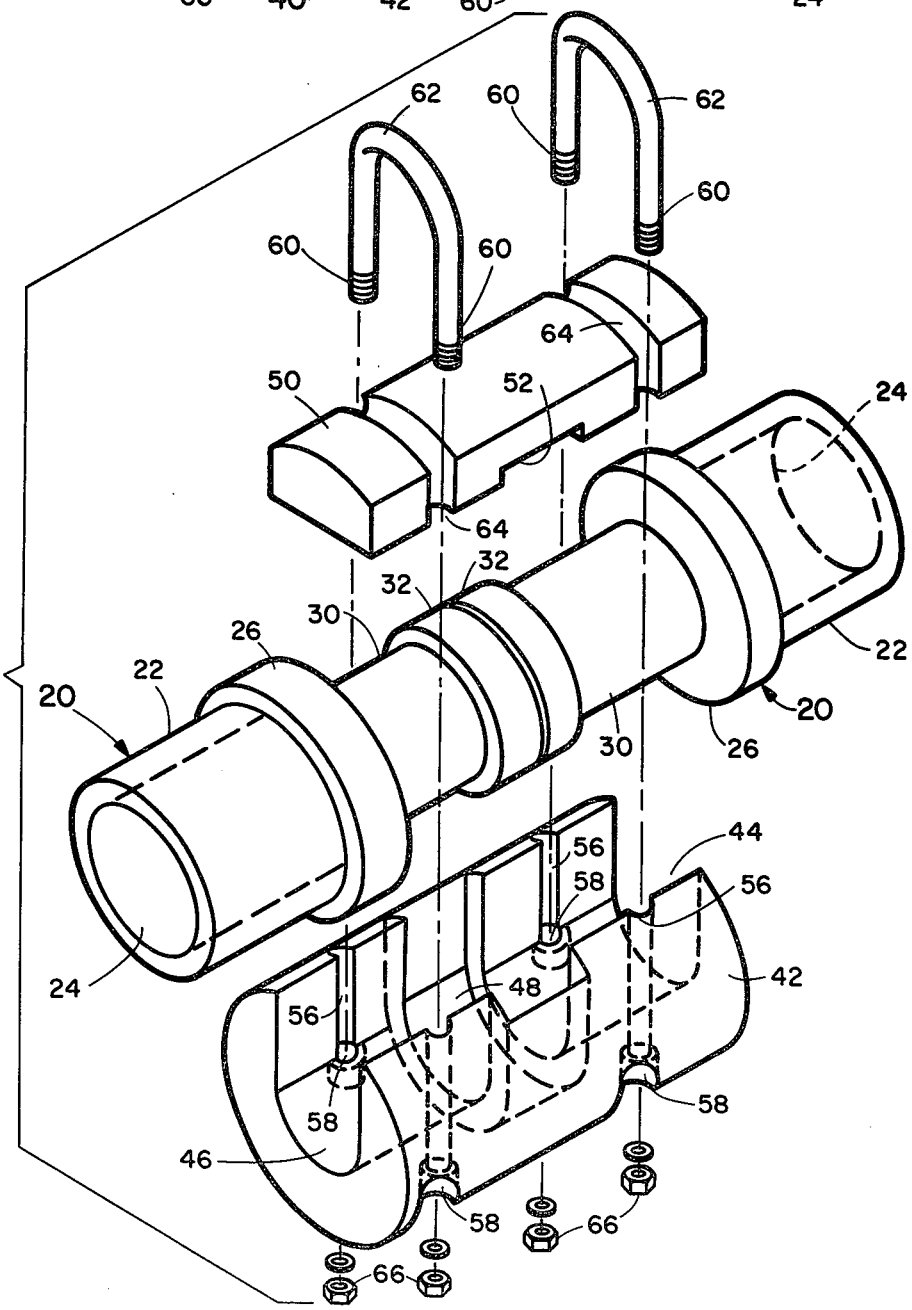
FIG. 2 is a perspective view illustrating major components of the assembly of FIG. 1 in dissassembled form.

In the exemplary form of the invention illustrated in the drawings and described hereinafter, a terminal and connector assembly is indicated generally at 10 and serves to mechanically and electrically couple the ends of two large diameter electrical cables 12. In this example, the cables 12 comprise a helical layer 14 of conductive wire, covered by a protective jacket 16 of an insulating and abrasive resistant plastic material. The assembly 10 comprises a copper or other metallic terminal 20 fixed to the end of each cable 12, with two such terminals clamped in end-to-end axially aligned relation by a connector 40.

Each terminal 20 comprises a hollow cylindrical body 22 including a reduced portion having a bore 24 in which the bared wire layer 14 of a cable end can be received and fixed as by crimping of the base 22. Other methods of fixing may also be used, including pinning, soldering, etc. The terminal body 22 conveniently includes a flange 26 against which a molded, soft rubber collar 28 terminates, the collar extending over and molded to a portion of the cable jacket 16.

Extending axially from the terminal body 22, on the side of flange 26 remote from the bore 24, is a cylindrical stem 30. At the distal end of the stem 30 is an enlarged, cylindrical knob 32. Thus, the stem 30 represents a reduced diameter portion of the terminal between the knob 32 and the body flange 26.

The connector 40 is adapted to receive and clamp the stem and knob members 30,32 of two, axially aligned terminals 20. To this end the connector 40 comprises a generally cylindrical body 42, formed of copper or other suitable material, defining a recess 44 opening radially through one side of the body which has semi-cylindrical inner surfaces 46 that are complementary to the stems 30 and a semi-cylindrical recess enlargement 48 that accomodates the two knobs 32. The terminal stems and knobs, when positioned in the recess 44 so as to be coaxial with the body, are adapted to be clamped in that relation by a keeper element 50. The keeper element 50, which is advantageously of the same material as the body 42, is sized to fit nicely into the recess 44 and has a central recess 52 that fits over the knobs 32.

The connector body 42 has grooves 56 and counterbored apertures 58 to accommodate and receive the legs 60 of a pair of U-bolts 62. The keeper element 50 is provided with grooves 64 to accommodate the U-bolts, and when assembled with the body 42 is held in tightly clamping relation to the terminals 20 by the U-bolts and nuts 66 on the legs 60. The knobs 32 are captivated in the electrical path between the cables 12, as well as a rugged mechanical connection.

It will be recognized that during connection of the cables 12 using the assembly 10, it is not necessary to perform any rotative positioning of either cable, and that the terminals 20 can be placed in the recess 44 of body 42 individually, that is one at a time since the body cooperates with the knob 32 and the flange 26 to axially position each terminal so that neither terminal will interfere with insertion of the other.

The resulting assembly 10 is neat in appearance and, due to recessing of the keeper, the U-bolts, and the nuts, is free of elements or projections that could hang-up on other equipment during handling. A rubber sleeve (not shown) can be slipped over the assembly 10 and clamped to the rubber collars 28 to provide a waterproof and electrically insulated connection.

Obviously, other embodiments and modifications of the subject invention will readily come to the mind of one skilled in the art having the benefit of the teachings presented in the foregoing description and the drawing. It is, therefore, to be understood that this invention is not to be limited thereto and that said modifications and embodiments are intended to be included within the scope of the appended claims.

What is claimed is:

1. A cable terminal and connector device for effecting end-to-end connection of cables without requiring rotative alignment, said device comprising:

first and second terminals each comprising a cylindrical terminal body having an axial cavity in which is fixable an end of a cable to be connected, a cylindrical stem extending from said terminal body axially away from said cavity, and a cylindrical knob formed on the end of said stem;

a cylindrical connector body defining a recess opening through one side thereof and having inner semi-cylindrical surfaces complementary to said stems when in axial alignment, said connector body having a semi-cylindrical central enlargement to said recess that accommodates said knobs;

said terminals being confined against axial movement in either direction by cooperation of said knobs and said terminal bodies with said connector body, whereby one or the other terminal can be individually assembled in said connector body without interference from the other terminal;

a keeper element received in said recess of said connector body in clamped retaining relation to the stems and knobs of said first and second terminals, said keeper element having a central recess receiving a portion of said knobs whereby forces tending to axially separate said terminals are transferred to said connector body and to said keeper element; and fastening means for securing said keeper element in said clamped retraining relation;

said fastening means comprising U-bolt means, and said keeper element and said connector body being provided with grooves and apertures for receiving said U-bolt means.

2. A cable terminal and connector device as defined in claim 1, and wherein:

said terminals, said connector body, and said keeper element are formed of metallic conductor materials.

3. A cable terminal and connector device as defined in claim 2, and wherein:

said terminals each comprise a radially extending flange extending from said body portion, said flange having a diameter substantially equal to the diameter of said connector body.

4. A cable end connecting assembly comprising in combination:

first and second cable end terminals formed of metal and each comprising a cylindrical body portion of a first diameter and having a cavity in which a cable end is fixed, a flange extending radially from said body portion and having a second diameter, a cylindrical stem portion of a third diameter smaller than said first diameter and extending axially from said body portion away from said cavity, and a cylindrical knob formed on the distal end of said stem portion, said knob having a diameter greater than the diameter of said stem and smaller than the diameter of said flange;

a generally cylindrical, rigid metal connector body having an outside diameter substantially equal to the diameter of said flange, said body having a length substantially equal to the distance between the flanges of said first and second terminals when axially aligned with the respective knobs adjacent one another, said body defining a recess along the length thereof and opening radially through the side thereof, said recess having end portions sized to receive said aligned terminal stem portions in closely fitting relation and having a central enlarged portion sized to receive said adjacent knobs in closely fitting relation;

a keeper element disposed in said recess over said stem portions and said knobs, said keeper element having an outer surface substantially coextensive with the outer surface of said connector body and having an inner surface characterized by a central recess in which portions of said knobs are received, said inner surface of said keeper element having end portions bearing against said stem portions; and a plurality of threaded fastener elements extending between said connector body and said keeper element and operative to draw them together in clamping relation to said stem portions and said knobs.

* * * * *